US006649821B2

(12) United States Patent
Inoue

(10) Patent No.: US 6,649,821 B2
(45) Date of Patent: Nov. 18, 2003

(54) KEYBOARD MUSICAL INSTRUMENT EQUIPPED WITH KEY-TOUCH REGULATOR PROVIDED BETWEEN KEYS AND STATIONERY MEMBER

(75) Inventor: Satoshi Inoue, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 88 days.

(21) Appl. No.: 10/028,006

(22) Filed: Dec. 21, 2001

(65) Prior Publication Data

US 2002/0078816 A1 Jun. 27, 2002

(30) Foreign Application Priority Data

Dec. 25, 2000 (JP) ..... 2000-393138

(51) Int. Cl.[7] ..... G10C 3/12
(52) U.S. Cl. ..... 84/423 R; 84/427; 84/424
(58) Field of Search ..... 84/423 R, 424, 84/425, 426, 427, 430, 431, 432, 433, 434, 435

(56) References Cited

U.S. PATENT DOCUMENTS 5,610,356 A * 3/1997 Koseki et al. ..... 84/719
5,648,621 A * 7/1997 Sasaki ..... 84/171
5,783,765 A * 7/1998 Muramatsu ..... 84/615
6,297,437 B1 * 10/2001 Ura et al. ..... 84/423 R

* cited by examiner

*Primary Examiner*—Kimberly Lockett
(74) *Attorney, Agent, or Firm*—Morrison & Foerster LLP

(57) ABSTRACT

A grand piano have a keyboard implemented by white and black keys selectively depressed by a player for specifying the notes of tones to be generated, and action units are linked with the white and black keys so as to give rise to free rotation of associated hammers through escape, wherein a key-touch regulator is provided between the key frame and the white and black keys for partially canceling the moment initially exerted on the white and black keys due to the self-weight of the action units and the hammers so that any lead weights is not required for regulating the key-touch.

20 Claims, 7 Drawing Sheets

KEYBOARD MUSICAL INSTRUMENT EQUIPPED WITH KEY-TOUCH REGULATOR PROVIDED BETWEEN KEYS AND STATIONERY MEMBER

FIELD OF THE INVENTION

This invention relates to keyboard musical instrument and, more particularly, to a keyboard musical instrument equipped with a key-touch generator for giving appropriate key-touch to the player.

DESCRIPTION OF THE RELATED ART

The "key-touch" is an important factor to players. When a pianist initiates depressing a key of an acoustic piano, the pianist feels the key heavy. The pianist soon notices the key becoming light on the way to the end position. The change of resistance is called as "key-touch". While a pianist is playing a piece of music on the acoustic piano, he or she delicately controls the force exerted on the keys for his or her artificial expression. If an acoustic piano to be played gives a key-touch different from that of the acoustic piano familiar to a player, he or she would be puzzled how to play with expression, because the key motion is unusual. Thus, the key-touch directly concerns his or her performance, and pianists desire acoustic pianos to give the same key touch as the acoustic piano familiar to them does. Nevertheless, pianists sometimes feel the acoustic pianos different from that of the acoustic piano familiar to him or her.

A piano manufacturer has his own specifications to be applied to the manufactured pianos. When the manufacturer completes products of an acoustic piano, the manufacturer inspects the products to see whether or not the products satisfy the specification. In the inspection, the manufacturer uniformly applies the standards in the specification to the products. In the inspection, the inspector checks the products for the standard key-touch, and a tuner uniformly regulates the key touch in accordance with the specifications, if necessary. Thus, the products of the acoustic piano are expected to give the standard key-touch to pianists. However, the key-touch is to be varied with time. For this reason, the pianists usually feel other pianos different in key-touch from the piano familiar to him or her.

The grand piano is a typical example of the keyboard musical instrument. FIG. 1 shows a key forming a part of the keyboard incorporated in the standard grand piano. In the following description, term "front" is indicative of a position closer to a pianist sitting in front of a piano than a position modified with "rear". Term "longitudinal" is indicative of a direction passing through a front point and a corresponding rear point, and "lateral direction" is perpendicular to the longitudinal direction.

Reference numeral 1 designates the key. Through-holes 2 are formed in the key 1 at intervals in the longitudinal direction, and weights 3 are snugly received in the through-holes 2. The weights 3 are formed of lead. The reason why the manufacturer uses the lead weights 3 is that the lead is deformable and easy to fill the through-holes. Another reason is the large specific weight. The key 1 is put on a balance rail 4*a*, and a balance pin 4*b* is upright on the balance rail 4*a*. The balance pin 4*b* passes through the central portion of the key 1, and the key 1 is rotatable about an axis perpendicular to the balance pin 4*b*. A front rail 6*a* laterally extends under the front portion of the key 1, and a rear rail 6*b* also laterally extends under the rear portion of the key 1. The front rail 6*a* sets a limit to the rotation of the key 1 in the counter clockwise direction, and the rear rail 6*b* sets a limit to the rotation of the key 1 in the clockwise direction.

An action 5 is rotatably supported by a whippen rail 9, which in turn is supported by action brackets 6*c*. The key 1 is held in contact with the action 5 through a capstan screw 7, and a hammer 8 is engaged with the action 5. The action is broken down into a whippen assembly 11*a*, a repletion lever assembly 11*b* and a jack 11*c*. The whippen assembly 11*a* is rotatably connected at the right end thereof to a whippen flange 11*d*, which in turn is fixed to the whippen rail 9. The repetition lever assembly 11*b* is provided on the intermediate portion of the whippen assembly 11*a*, and a through-hole is formed in the left portion of the repetition lever assembly 11*b*. The jack 11*c* is rotatably connected to the left portion of the whippen assembly 11*a*, and has a leg portion, a foot portion and a toe. The leg portion projects into the through-hole, and the hammer 8 is engaged with the leg portion. On the other hand, the toe is opposed to a regulating button 11*e*.

The hammer 8 is rotatably supported by a shank flange rail 6*d* under an associated set of strings, and the shank flange rail 6*d* is supported by the action brackets 6*c*. The hammer 8 pushes down the whippen assembly 11*a* due to the self-weight, and the whippen assembly 11*a* in turn pushes down the capstan screw 7. The force due to the total self-weight of the hammer and whippen assembly 8/11*a* is exerted on the rear portion of the key 1 through the capstan screw 7, and gives rise to the rotation of the key 1 in the clockwise direction. For this reason, the rear portion is in contact with the rear rail 6*b*, and the front portion is spaced from the front rail 6*a*.

When a pianist depresses the front portion of the key 1, the force gives rise to the rotation of the key 1 in the counter clockwise direction against the total self-weight of the hammer and whippen assembly 8/11*a*, and the depressed key 1 actuates the action 5. In detail, the capstan screw 7 upwardly pushes the whippen assembly 11*a*, and gives rise to rotation of the whippen assembly 11*a* about the whippen flange 11*d*. The jack 11*c* is rotated together with the whippen assembly 11*a*, and the toe is getting closer and closer to the regulating button 11*e*. When the toe is brought into contact with the regulating button 11*e*, the jack 11*c* turns about the left end of the whippen assembly 11*a*, and escapes from the hammer 8. When the jack 11*c* escapes from the hammer 8, the hammer 8 starts free rotation. Although the pianist further rotates the key 1, he or she exerts the force on the front portion of the key 1 against only the self-weight of the whippen assembly 11*a*. The self-weight never serves as the resistance. For this reason, the pianist feels the key 1 light.

Thus, the key 1 is moved at the balance between the moment due to the self-weight of the hammer and whippen assembly 8/11*a* and the moment due to the force exerted on the front portion by the pianist. The larger the difference between the moments is, the heavier the pianist feels the key 1. The weights 3 partially cancel the moment due to the total self-weight of the hammer and whippen assembly 8/11*a*, and render the key-touch light. However, it is difficult for the user to change the original weights 3 to other weights. Thus, only the manufacturer regulates the keys 1 to the standard key-touch by using the weights 3.

The manufacturer encounters a problem in that the lead is detrimental to health and harmful to the environment. The manufacturer tries to change the lead to another kind of metal such as iron and brass. However, these kinds of metal make the regulating work and assembling work difficult.

This is because of the fact that the iron and brass are less deformable rather than the lead. In order to snugly insert the iron weights into the through-holes 2, a force fitting system is required for the iron or brass weights. However, the keys 1 are liable to be broken in the force fitting, and the force fitting is undesirable for the wooden keys 1. Otherwise, the iron or brass weights are loosely inserted into the through-holes 2, and are adhered to the wooden keys 1. The wooden keys 1 are free from the breakage. However, the adhesive compound is less reliable. Moreover, the workers keep the iron or brass weights inside of the through-holes until the adhesive compound is solidified. If the worker supplies the adhesive compound too much, the adhesive compound flows out from the through-holes, and the worker needs to wipe the excess adhesive compound. Thus, the adhesive compound makes the assembling work complicated and, accordingly, is less desirable.

A solution is proposed in Japanese Patent Application laid-open No. 2000-25147. A spring is proposed in the Japanese Patent Application laid-open. The spring 10 is provided between the whippen rail 9 and the whippen assembly 11 as shown in FIG. 1. The spring 10 exerts an elastic force on the whippen assembly 11, and causes the whippen rail 9 to support part of the total self-weight of the hammer/whippen assembly 8/11. Thus, the spring 10 cancels the part of the total self-weight of the hammer/whippen assembly 8/11 exerted on the rear portion of the key 1, and makes the key-touch light. Thus, the spring 10 serves as a key-touch regulator.

However, a problem is encountered in the prior art grand piano equipped with the key-touch regulator implemented by the spring 10 in that the distance between the hammers 8 and the associated strings is fixed after the insertion of the spring 10 between the whippen rail 9 and the whippen assembly 11. In the standard grand piano, the distance between the hammers 8 and the strings is independently regulable. The distance between the hammers 8 and the associated strings has an influence on the quality of the tone. If a set of strings generates a tone different from other tones, the distance between the hammer 8 and the string may be varied. In this situation, a tuner turns the capstan button 7 so as to lift up the whippen assembly 11 or permit the whippen assembly 11 to fall. The hammer 8 follows the whippen assembly 11, and the distance is widened or narrowed. However, when the tuner turns the capstan button 7 after the insertion of the spring 10, the elastic force is varied together with the position of the whippen assembly 11, and makes the associated key 1 different in key-touch from the other keys 1. In order to keep the key-touch uniform, the tuner keeps the capstan buttons 7 at the original height. Otherwise, the tuner deforms the springs 10 so as to decrease or increase the elastic forces. Thus, the prior art key-touch regulator 10 brings another problem into the tuning work on the standard grand piano.

Another prior art key-touch regulator is disclosed in Japanese Patent No. 2938295. Pairs of permanent magnet pieces are introduced into the keyboard. The pairs of permanent magnet pieces are attached to the keys and a stationary board in such a manner that the permanent magnet pieces attached to the keys are repulsed by the permanent magnet pieces on the stationary board. The magnetic force cancels part of the total self-weight of the hammer and action, and makes the key-touch light. However, the magnetic force is rapidly reduced inversely proportional to the square of the distance between the keys and the stationary board. In other words, the amount of force canceled is varied depending upon the current key position on the trajectory thereof. If the magnetic force is weak, the cancellation is only limited in the proximity of the initial positions of the keys. On the other hand, if the permanent magnetic pieces create extremely strong magnetic field, the pianist feels the key too light. Thus, the prior art key-touch regulator implemented by the permanent magnetic pieces can not give the appropriate key-touch to the pianists.

SUMMARY OF THE INVENTION

It is therefore an important object of the present invention to provide a keyboard musical instrument, which gives predetermined key-touch to user over the full strokes of keys regardless of a tuning work.

To accomplish the object, the present invention proposes to provide a key-touch regulator between movable keys and a stationary board so as to exerts elastic force on the keys.

In accordance with one aspect of the present invention, there is provided a keyboard musical instrument comprising an array of keys selectively moved with respect to a stationary board by a human player, a driven mechanism including plural units respectively linked with the keys of the array so as to be selectively actuated by the associated keys and exerting initial loads to the keys, respectively, and a touch-regulator having plural elastic force generating units provided between the keys and the stationary board and exerting elastic forces to the keys over the full strokes of the keys so as to cancel parts of the initial loads.

BRIEF DESCRIPTION OF THE DRAWINGS

The features and advantages of the keyboard musical instrument will be more clearly understood from the following description taken in conjunction with the accompanying drawings in which.

DESCRIPTION OF THE PREFERRED EMBODIMENTS

First Embodiment

Figure 2:
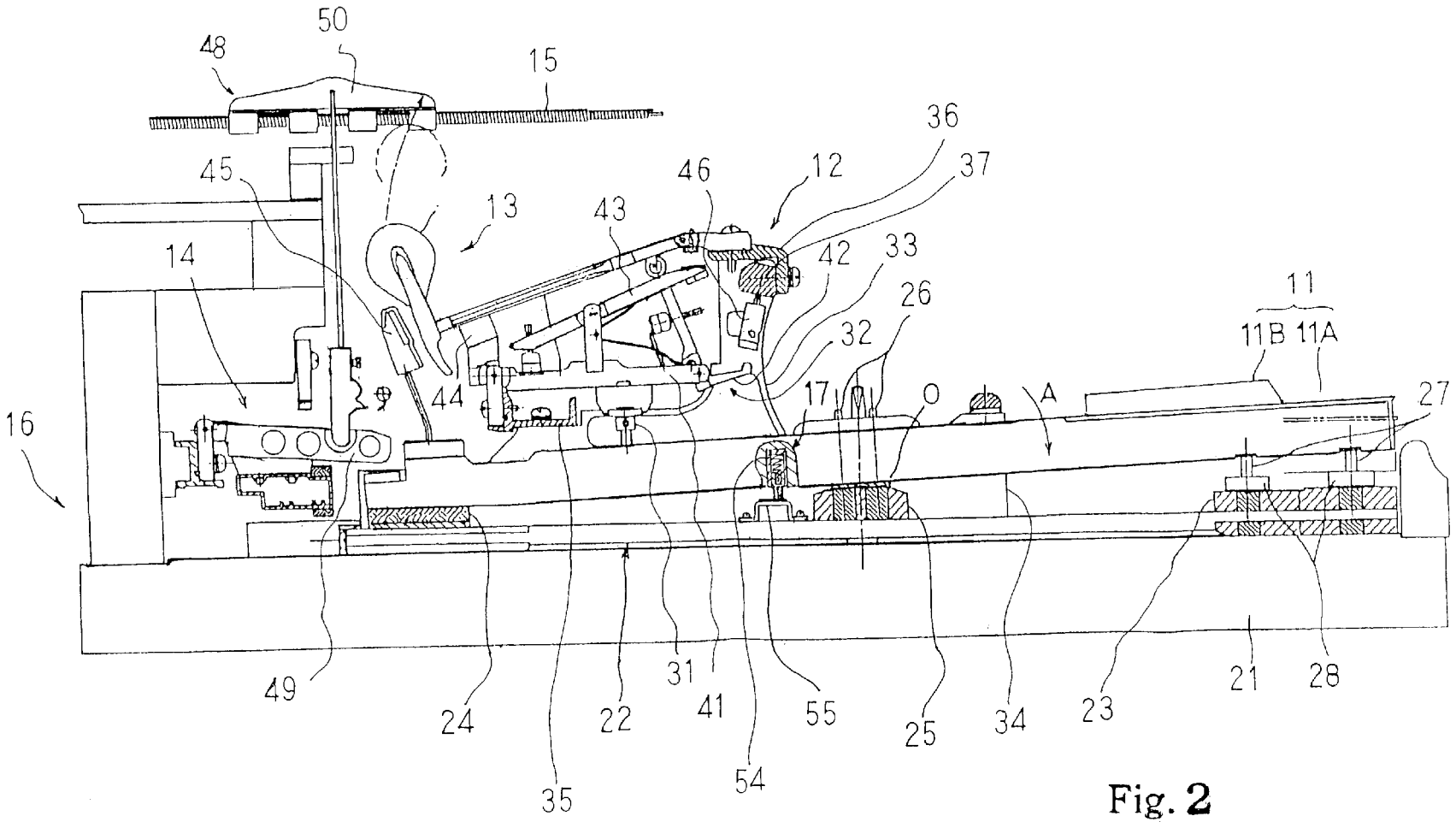
FIG. 2 is a partially cut-away side view showing essential parts of a grand piano according to the present invention.

Referring to FIG. 2 of the drawings, a grand piano embodying the present invention largely comprises a keyboard 11, a key action mechanism 12, an array of hammer assemblies 13, a damper mechanism 14, sets of strings 15 and a piano case 16. An inner space is defined in the piano case 16, and legs (not shown) support the piano case 16 over a floor. The key action mechanism 12, the array of hammer assemblies 13, the damper mechanism 14 and the sets of strings 15 are housed in the piano case 16. The keyboard 11 is exposed to a pianist, and is connected to the key action mechanism 12. The hammer assemblies 13 are engaged with the key action mechanism 12, and are selectively driven for rotation by the key action mechanism 12. The sets of strings 15 are stretched over the hammer assemblies 13, and the damper mechanism 14 permits the sets of strings 15 to vibrate after the pianist manipulates the keyboard 11. While the pianist is fingering a piece of music on the keyboard 11, the key action mechanism 12 and the damper mechanism 14 are actuated. The damper mechanism 14 selectively permits the sets of strings 15 to vibrate, and the key action mechanism 12 drives the hammer assemblies 13 for free rotation. The hammer assemblies 13 thus driven for rotation strike the associated strings 15, and rebound thereon. The strings 15 vibrate, and generate the tones. When the hammer assemblies 13 start the free rotation, only the key action mechanism 12 is left as the resistance against the manipulation on the keyboard 11. Thus, the key action mechanism 12 and the hammer assemblies 13 give key-touch to the pianist through the keyboard 11.

The grand piano according to the present invention further comprises a key-touch regulator 17, and the key-touch regulator 17 is provided under the keyboard 11. The key-touch regulator 17 cancels part of the counter moment against the manipulation, and makes the key-touch appropriate to the pianist.

A key bed 21 is the bottom of the piano case 16, and a key frame 22 is mounted on the key bed 21. The key frame 22 includes a front rail 23, back rail 24 and a balance rail 25. The front rail 23 and the back rail 24 laterally extend on the key bed 21, and respectively define a front end and a rear end of the key frame 22. The balance rail 25 also laterally extends, and balance pins 26 upwardly project from the balance rail 26 at intervals. Front pins 27 upwardly project from the front rail 23, and are arranged in a staggered manner. The front pins 27 pass through front pin punching clothes 28 on the front rail 23.

The key frame 22, the balance pins 26, the front pins 27 and the front pin punching clothes 28 form the keyboard 11 together with white keys 11A and black keys 11B. The white keys 11A and the black keys 11B are laid on the well known-pattern, and the notes of the scale are respectively assigned the white/black keys 11A/11B. Through-holes are formed in the intermediate portions of the white/black keys 11A/11B, and recesses are open to the lower surface of the front portions of the white/black keys 11A/11B. Capstan screws 31 upwardly project from the rear portions of the white/black keys 11A/11B, respectively, and the white/black keys 11A/11B are linked with the key action mechanism 12 through the capstan screws 31 as will be described hereinlater in detail. The white/black keys 11A/11B are placed on the balance rail 25 such that the balance pins 26 and the front pins 27 are inserted into the through-holes and the recesses. Thus, the white/black keys 11A/11B are rotatable around the balance rail 25. However, any lead weight is not embedded in the white/black keys 11A/11B. This is because of the fact that the key-touch regulator 17 regulates the counter moment against the key motion to appropriate value.

The key action mechanism 12 has plural action units 32, which are respectively associated with the white/black keys 11A/11B. The key motion is transmitted through the capstan screws 31 to the action units 32, and the white/black keys 11A/11B receive the total self-weight of the associated action units 32 and the associated hammer assemblies 13. For this reason, the white/black keys 11A/11B are in contact with the rear rail 24 at the rear portions thereof, and the front portions are spaced from the front pin punching clothes 28 in so far as a pianist does not exert any force on the front portions of the white/black keys 11A/11B.

The action units 32 are provided over the rear portions of the white/black keys 11A/11B. Action brackets 33 are bolted to bracket blocks 34, and the bracket blocks 34, and, accordingly, the action brackets 33 are mounted on the key frame 22 at intervals in the lateral direction. A whippen rail 35 laterally extends over the array of white/black keys 11A/11B, is bolted to the rear portions of the action brackets 33. A shank flange rail 36 further extends over the array of white/black keys 11A/11B in the lateral direction, and is bolted to the front portions of the action brackets 33. The shank flange rail 36 has an angle-like cross section, and a regulating rail 37 is fixed to the rear vertical surface of the shank flange rail 36. The action units 32 are partially supported by the whippen rail 35 and partially by the regulating rail 37 at intervals. The action units 32 are similar in structure to one another, and description is made on one of the action unit 32 shown in FIG. 2.

The action unit 32 includes a whippen assembly 41, a jack 42, a repetition lever 43, a stop felt 44, a back check 45 and a regulating button 46. The whippen assembly 41 is rotatably supported at the rear end portion thereof by the whippen rail 35 through a whippen flange, and the capstan screw 31 is held in contact with the lower surface of the whippen assembly 41. The capstan screw 31 transmits the force from the white/black key 11A/11B to the whippen assembly 41, and gives rise to rotation of the whippen assembly 41 about the whippen flange. The jack 42 is rotatably connected to the front end portion of the whippen assembly 41, and the repetition lever 43 is rotatably supported at the intermediate portion thereof by the whippen assembly 41 through a repetition lever flange. On the other hand, the regulating button 46 is hug from the regulating rail 37, and is opposed to the toe of the jack 42. While the depressed key 11A/11B is rotating the whippen assembly 41 about the whippen flange in the counter clockwise direction, the jack 42 is also rotated about the whippen flange without relative rotation about the front end portion of the whippen assembly 41, and the toe is getting closer and closer to the regulating button 46. The action unit 32 and the associated hammer assembly 13 exert the total self-weight on the associated white/black key 11A/11B, and produce the counter moment against the downward key motion. When the toe is brought into contact with the regulating button 46, the jack 42 is rotated about the front end portion of the whippen assembly 41 so as to escape from the associated hammer assembly 13. After the escape, the depressed key 11A/11B receives only the self-weight of the action unit 32 through the capstan screw 31, and the counter moment is reduced. For this reason, the pianist notices the depressed key becoming light. Thus, the action unit 32 cooperates with the associated hammer assembly 13, and gives the unique key-touch to the pianist.

The stop felt 44 is fixed to the rear end of the whippen assembly 41, and the back check 45 projects upwardly from the rear end of the white/black key 11A/11B. The back check 45 receives the hammer assembly 13 after rebounding on the strings 15, and hands the hammer assembly 13 to the stop felt 44 after the pianist releases the depressed key 11A/11B.

The hammer assemblies 13 are respectively associated with the action units 32 and, accordingly, white/black keys 11A/11B, and are rotatably connected to the shank flange rail 36 at intervals. The hammer assembly 13 has a hammer felt, a hammer shank, a shank flange and a hammer roller. The shank flange is fixed to the shank flange rail 36, and the hammer shank is rotatably connected to the shank flange. While the toe is approaching to the regulating button 46, the hammer roller is held in contact with the leg portion of the jack 32, and the hammer assembly 13 is rotated about the shank flange together with the whippen assembly 41 and the jack 42. When the jack 42 escapes from the hammer assembly 13, the jack 42 kicks the hammer roller, and gives rise to the free rotation toward the string 15. The hammer assembly 13 strikes the string 15, and rebounds thereon. The back check 45 receives the hammer assembly 45 as described hereinbefore.

The damper mechanism 14 includes plural damper units 48 associated with the sets of strings 15, respectively. The damper units 48 includes a damper lever 49 to be actuated by the rear portion of the associated white/black key 11A/11B and a damper head 50 connected through a damper wire to the damper lever 49. While the associated white/black key 11A/11B is staying at the rest position as shown in FIG. 2, the damper lever 49 is spaced from the rear portion of the white/black key 11A/11B, and the damper head 50 is held in contact with the associated string 15. The rear portion of the associated key 11A/11B is brought into contact with the damper lever on the way to the end position. The damper lever 49 is lifted, and the damper head 50 is spaced from the string 15. The string 15 is permitted to vibrate. When the pianist releases the white/black key 11A/11B, the white/black key 11A/11B returns toward the rest position. The rear portion is spaced from the damper lever 49 on the way to the rest position, and the damper head 50 is brought into contact with the string 15 so as to damp the vibrations.

The key-touch regulator 17 includes plural pushers 54 and a receiver 55. A metal plate is shaped into a channel bar **55*a*, and a sheet of felt or cloth 55*b* is adhered to the upper surface of the channel bar 55*a*. The sheet of felt or cloth 55*b* serves as a muffler. Even if the pusher 54 impinges against the receiver 55, serious noise is never generated. The channel bar 55*a* and the sheet of felt/cloth as a whole constitute the receiver 55. The receiver 55 laterally extends under the rear portions of the white/black keys 11A/11B, and is bolted to the key frame 22 in such a manner as to have a land portion spaced from the key frame 22. The pushers 54 are respectively associated with the white/black keys 11A/11B, and are embedded in the rear portions of the associated white/black key 11A/11B, respectively. Each of the pushers 54 downwardly projects from the lower surface of the associated white/black key 11A/11B, and always exerts force on the upper surface of the receiver 55. The reaction is received by the rear portion of the associated white/black key 11A/11B**, and produces the counter moment in the clockwise direction.

Figure 3:
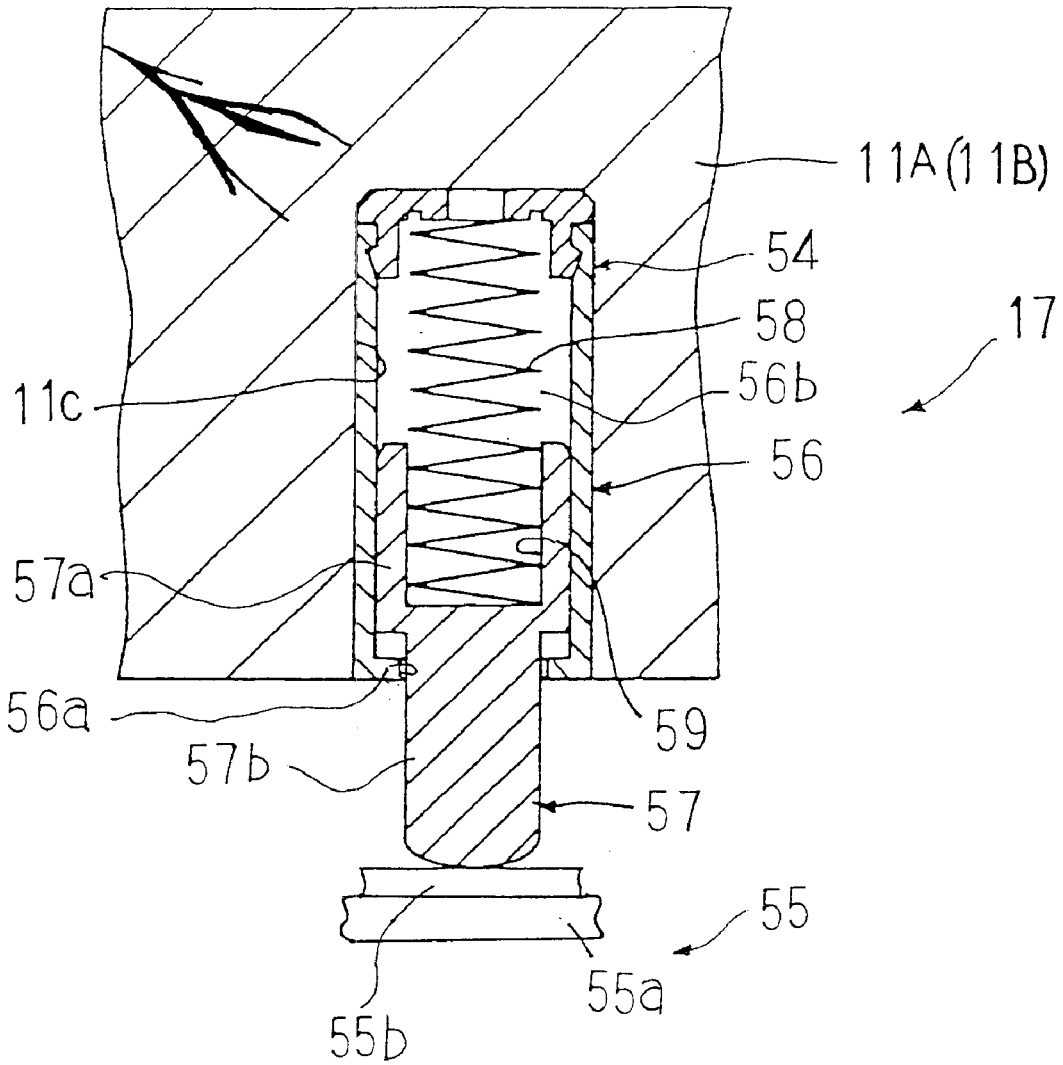
FIG. 3 is a cross sectional view showing the structure of a key-touch regulator incorporated in the grand piano according to the present invention.

Turning to FIG. 3 of the drawings, one of the pushers 54 exerts the force on the receiver 55. A recess **11*c* is formed in the rear portion, and is open to the lower surface of the associated white/black key 11A/11B. The pusher 54 includes a cylinder 56, a plunger 57 and a compression coil spring 58. The cylinder 56 is embedded in the associated white/black key 11A/11B, and has an aperture 56*a* and an inner space 56*b*. The inner space 56*b* is larger in diameter than the aperture 56*a*. On the other hand, the plunger 57 has a thick portion 57*a* and a thin portion 57*b*. The thick portion 57*a* is slidable in the inner space 56*b*, and the thin portion 57*b* projects from the inner space through the aperture 56*a*. Since the aperture 56*a* is smaller in diameter than the thick portion 57*a*, only the thin portion 56*a* projects from the cylinder 56. A recess 59 is formed in the thick portion 57*a*, and receives the lower portion of the compression coil spring 58. The upper end of the compression coil spring 58 is held in contact with the inner surface of the cylinder 56. The distance between the bottom surface of the recess 59 and the inner surface is smaller in length than the free length of the compression coil spring 58. When the compression coil spring 58 is provided between the cylinder 56 and the plunger 57, the compression coil spring 58 urges the plunger 57 in a direction in which the plunger 57 projects from the cylinder 56**.

Figure 4:
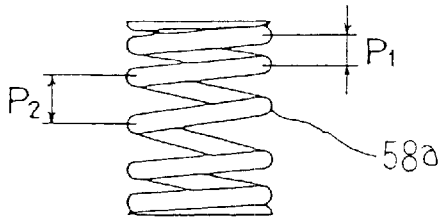
FIG. 4 is a front view showing the configuration of a compression coil spring available for the pusher.
Figure 5:
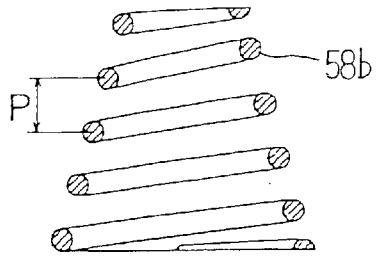
FIG. 5 is a front view showing the configuration of another compression coil spring available for the pusher.
Figure 6:
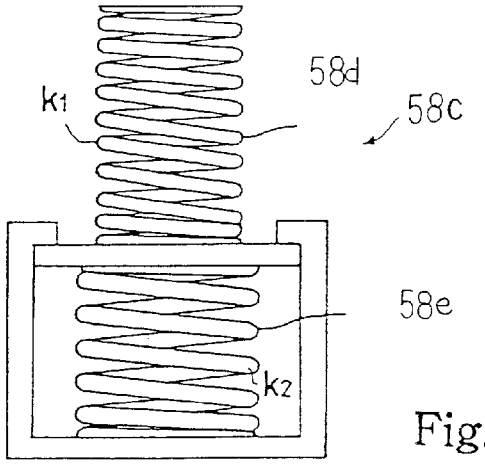
FIG. 6 is a front view showing the configuration of a composite coil spring available for the pusher.

The compression coil spring 58 has non-linear force-to-elongation characteristics. FIG. 4 shows a candidate **58*a* of the compression coil spring 58. The compression coil spring 58*a* has plural helixes. The helixes of the central portion are spaced at relatively wide intervals, and the helixes of both end portions are spaced at relatively narrow intervals. Thus, the compression coil spring 58*a* has the variable pitches, and has non-linear force-to-elongation characteristics. FIG. 5 shows another candidate 58*b* of the compression coil spring 58. The compression spring 58*b* also has plural helixes. Although the pitch P is constant, the helixes are gradually reduced in diameter from one end to the other. FIG. 6 shows yet another candidate 58*c* of the compression coil spring 58. The candidate 58*c* is a composite coil spring, i.e., a series combination of compression coil springs 58*d* and 58*e*. The compression coil springs 58*d* and 58*e*** have different values k1 and k2 of the spring constant. In this instance, the spring constant k2 is greater than the spring constant k1.

Figure 1:
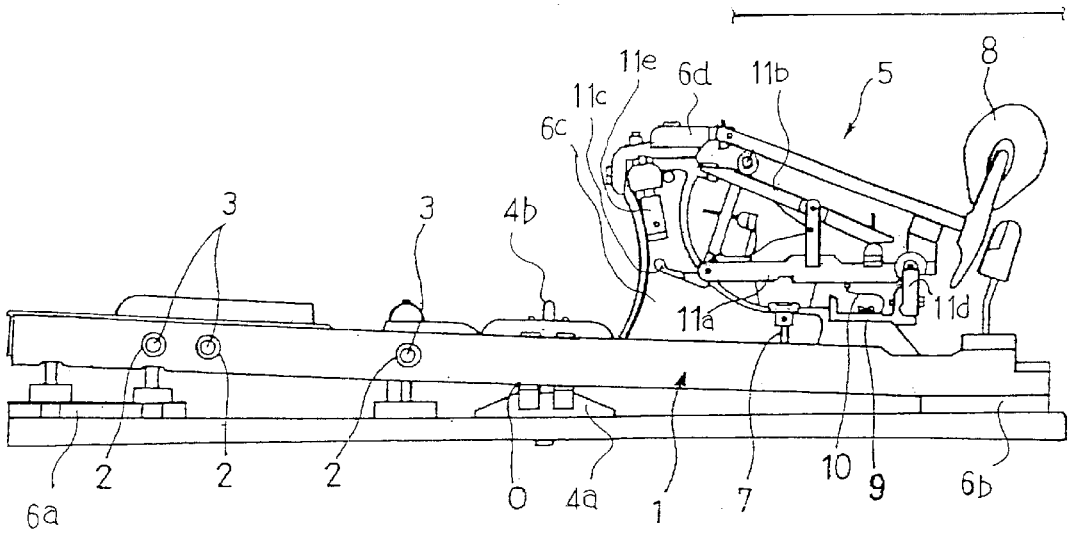
Fig. 1 PRIOR ART
FIG. 1 is a side view showing the key, action and hammer incorporated in the prior art grand piano.
Figure 7:
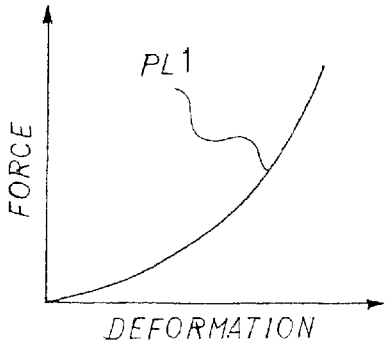
FIG. 7 is a graph showing force-and-deformation characteristics obtained in the compression coil springs shown in FIGS. 4 and 5.
Figure 8:
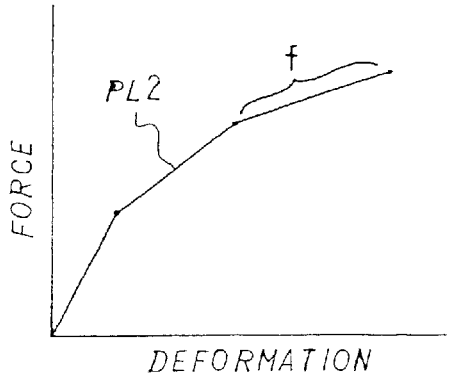
FIG. 8 is a graph showing force-and-deformation characteristics obtained in the compression coil spring shown in FIG. 6.

The compression coil springs **58*a*, 58*b* and 58*c* have non-linear force-and-deformation characteristics. The deformation of the compression coil springs 58*a*/58*b* is increased as indicated by plots PL1 in FIG. 7. On the other hand, the deformation is increased in the composite coil spring 58*c* as indicated by plots PL2 in FIG. 8. The force to be required for unit deformation is gradually increased in the compression coil springs 58*a*/58*b*. However, the force to be required for unit deformation is stepwise decreased in the composite coil spring 58*c*. Thus, a wide variety of the force-and-deformation characteristics are achieved by using different types of the compression coil spring. The manufacturer selects an appropriate spring from the candidates, and gives appropriate key-touch to pianists by using the selected spring. As described hereinbefore, the lead weights are embedded in the prior art white/black keys (see FIG. 1). The lead weights produces constant counter moment regardless of the current angular position of the white/black key. When the manufacturer decides to adjust the white/black keys 11A/11B to the standard key-touch same as that of the prior art keys, the manufacturer may appreciate a part of the force-and-deformation characteristics indicated by "f" in FIG. 8**.

While the white/black keys 11A/11B are staying at the rest positions, the gap between the receiver 55 and the white/black keys 11A/11B is minimum, and, accordingly, the plunger 57 is forcibly retracted into the cylinder 56 against the elastic force of the compression coil spring 58. The capstan screw 31 is spaced from the balance rail 25, and the action unit 32 and the associated hammer assembly 13 produces the moment in the counter clockwise direction due to the self-weight. The pusher 54 is also spaced from the balance rail 25, and produces the moment in the clockwise direction. The moment due to the elastic force cancels the part of the moment due to the self-weight. The compression coil spring 58 is gradually expanded together with the downward key motion, and the compression coil spring 58 keeps the plunger 57 held in contact with the receiver 55 until the white/black key 11A/11B reaches the end position. The compression coil spring 58 exerts the elastic force over the full stroke of the plunger 57, and, accordingly, the key-touch regulator 17 continuously gives the standard key-touch to the pianist over the full stroke of the white/black keys 11A/11B. Thus, the key-touch regulator 17 according to the present invention is superior to the prior art key-touch regulator implemented by the permanent magnet pieces.

When the pianist depresses the white/black key 11A/11B, he or she exerts the force on the front portion for producing the difference between the moment due to the self-weight and the moment due to the elastic force. The force exerted on the front portion is smaller than the force to be exerted on the front portion of a white/black key without any assistance of the pusher 54. The manufacturer designs the distance between the balance rail 25 and the pusher 54 and the elastic force of the compression coil spring 58 to give the standard key-touch to the pianist. Thus, the key-touch regulator 17 makes the white/black keys 11A/11B familiar without any lead weights.

The key-touch regulator 17 is installed in the white/black keys 11A/11B as follows. First, the manufacturer prepares the pusher 54 and the receiver 55. In this instance, the cylinder 56 and the plunger 57 are formed of synthetic resin. For this reason, the key-touch regulator 17 does not seriously increase the weight of the associated key 11A/11B. The cylinder 56, the compression coil spring 58 and the plunger 57 may be machined from metal bars such as steel bars or brass bars, and assembled into the pusher 54. Any piece of lead is not required for the pusher 54. A metal plate such as a steel plate or a brass plate is shaped into the channel bar 55*a*, and the sheet of felt/cloth 55*b* is adhered to the upper surface of the channel bar 55*a*. The recess 11*c* is formed in each key 11A/11B, and the pusher 54 is snugly inserted into the recess. Adhesive compound may be used between the white/black keys 11A/11B and the pushers 54. Thus, the key-touch regulator 17 according to the present invention does not pollute the environment.

The key-touch regulator 17 according to the present invention continuously gives the standard key-touch to pianists regardless of the tuning work on the capstan screws 31. Assuming now that the distance between a hammer felt and the associated string 15 is improper, a tuner regulates the distance by turning the capstan screw 31. The capstan screw 31 projects from or is retracted into the rear portion of the white/black key 11A/11B so as to lift the action unit 32 and the hammer assembly 13 or cause them to fall. Even though the action unit 32 changes the position, the white/black key 11A/11B remains unchanged. This means that the compression coil spring 58 keeps the elastic force unchanged. As a result, the key-touch regulator 17 still gives the standard key-touch to pianists regardless of the tuning work.

As will be understood from the foregoing description, the key-touch regulator 17 according to the present invention is provided between the white/black keys 11A/11B and the key frame 22. Even when the distance between the strings 15 and the hammer felts is tuned by changing the height of the capstan screws 31, the tuning work does not have any influence on the key-touch regulator 17, and, accordingly, the pianist feels the key-touch unchanged. Moreover, the spring 58 works in a wide effective range. The effective range is much wider than that of the permanent magnetic pieces. For this reason, the key-touch regulator 17 produces the counter moment over the full stroke of the white/black keys 11A/11B. Thus, the key-touch regulator 17 according to the present invention solves the problems inherent in the prior art key-touch regulators.

Second Embodiment

Figure 9:
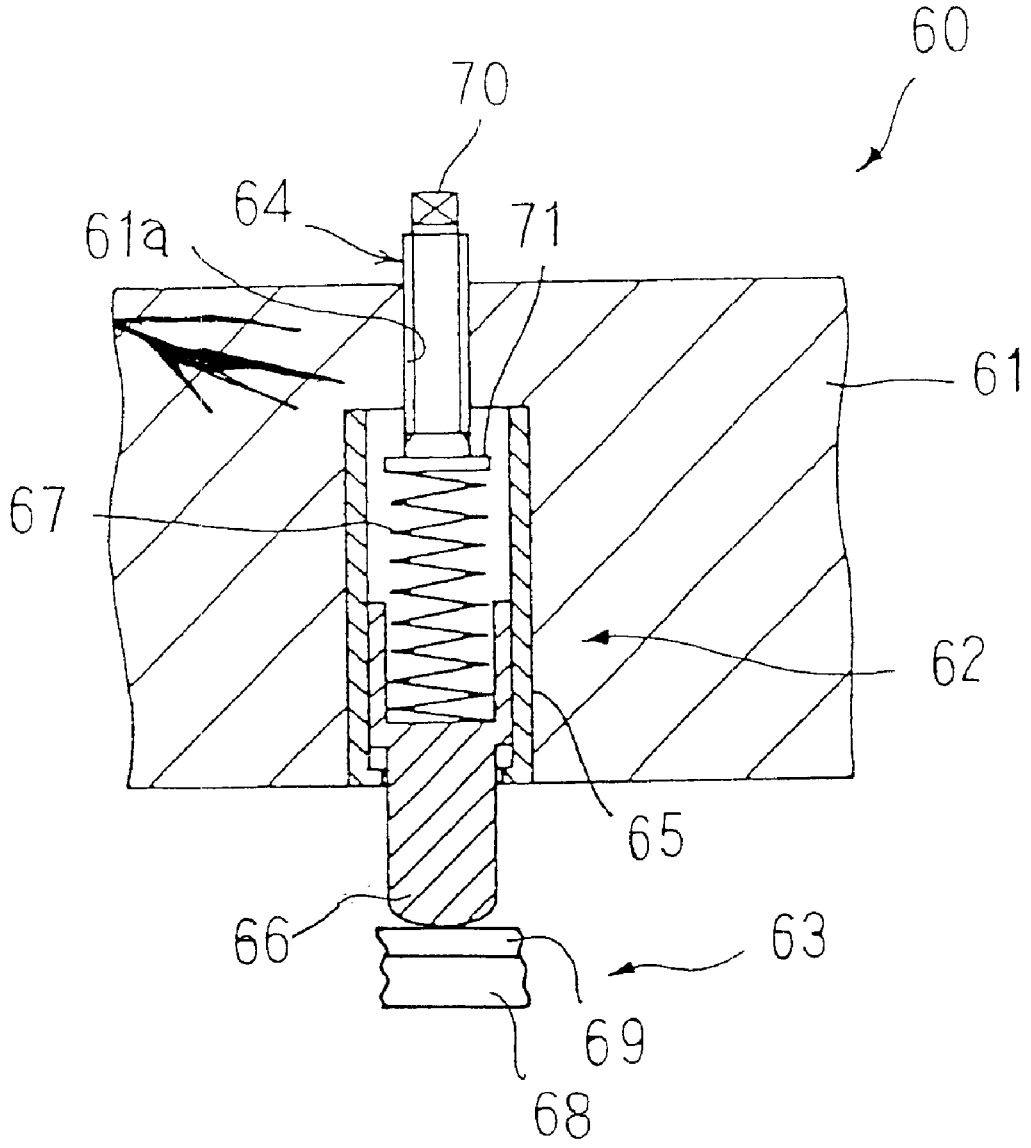
FIG. 9 is a cross sectional view showing the structure of another key-touch regulator according to the present invention.

Turning to FIG. 9 of the drawings, another key-touch regulator 60 embodying the present invention is provided between a keyboard and a key frame (not shown). A key 61 forms a part of the keyboard, and the keyboard is incorporated in a grand piano. The other components of the grand piano are similar to those of the grand piano shown in FIG. 2, and no further description is incorporated for the sake of simplicity.

The key-touch regulator 60 largely comprises pushers 62, a receiver 63 and adjusters 64. The pushers 62 are embedded in the keys of the keyboard, and each pusher 62 includes a cylinder 65, a plunger 66 and a compression coil spring 67. These component parts 65, 66 and 67 are similar to those of the pusher 54, and detailed description is omitted for avoiding repetition. The receiver 63 is shared among the pushers 62, and is fixed to the key frame (not shown). A channel bar 68 and a sheet of felt or cloth 69 as a whole constitute the receiver as similar to the receiver 55.

The adjusters 64 are respectively provided for the pushers 62, and each adjuster 64 is implemented by an adjusting screw 70 and a disc 71. A threaded hole 61*a* is formed in the key 61, and is open at both ends thereof to the upper surface of the key 61 and the inner space of the cylinder 65. The adjusting screw 70 passes through the threaded hole 61*a*. The head portion is over the upper surface of the key 61, and the leading end of the threaded stem portion is exposed to the recess. When a tuner turns the head portion of the adjusting screw 70, the threaded stem portion projects into inner space of the cylinder 65, and is retracted therefrom. The disc 71 is fixed to the leading end of the threaded stem portion, and is movable together with the adjusting screw 70. The compression coil spring 67 is held in contact with the disc 71, and varies the length depending upon the position of the disc 71.

Assuming now that a pianist feels the key 61 too heavy, the pianist or tuner turns the adjusting screw 70 with a suitable tool in such a manner as to press the disc 71 against the compression coil spring 67. The compression coil spring is contracted, and accumulates the force in the form of elastic strain energy. The compression coil spring 67 strongly presses the plunger 66 against the receiver 63, and, accordingly, the reaction force is increased. The counter moment is increased, and cancels larger part of the moment due to the total self-weight. As a result, the key-touch regulator 60 gives light key-touch to the pianist.

On the other hand, when the pianist feels the key 61 too light, the pianist or the tuner turns the adjusting screw 70 in such a manner as to retract the threaded stem portion from the inner space of the cylinder 65. The compression coil spring 67 is elongated, and the elastic strain energy is partially released. The compression coil spring 67 removes part of the force from the plunger 66, and the reaction force is also reduced. The counter moment is also reduced, and cancels smaller part of the moment due to the total self-weight. This results in the key-touch is heavier than the previous touch is.

The adjuster 64 is available for the factory tuning. Even though the pushers 62 and the receiver 63 are appropriately designed, error is unavoidable in the fabrication and assemblage, and the key-touch is dispersed in the keyboard due to the error. In this situation, the manufacturer regulates the counter moments to a certain value by turning the adjusting screws 70.

The pusher 62 and the receiver 63 achieve all the advantages of the key-touch regulator 17, and the adjuster 64 permits the manufacturer and user to change the key-touch easily.

Third Embodiment

Figure 10:
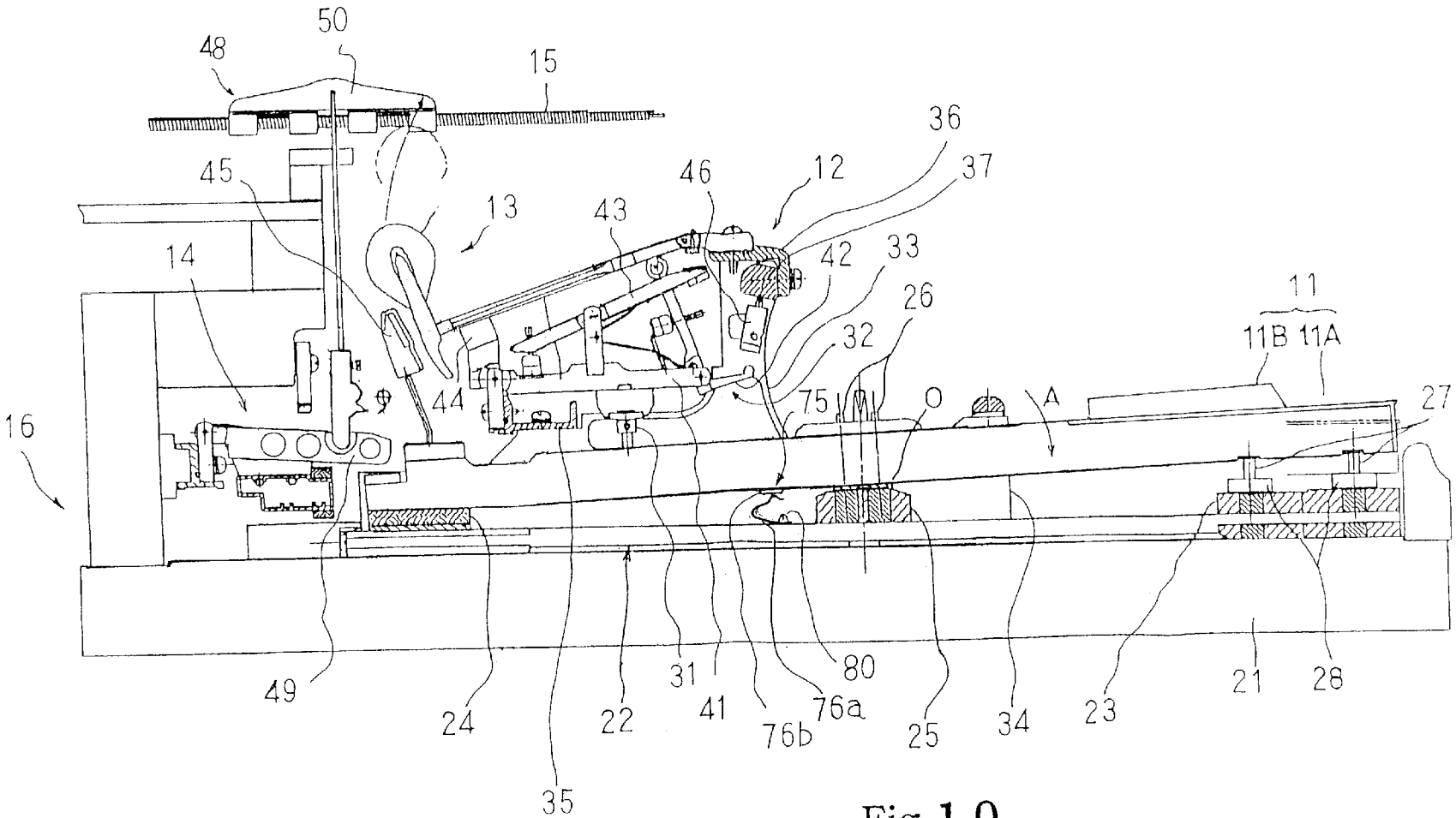
FIG. 10 is a partially cut-away side view showing the essential parts of another grand piano according to the present invention.

Turning to FIG. 10 of the drawings, another grand piano is equipped with yet another key-touch regulator embodying the present invention 75. Since the grand piano is similar to the grand piano shown in FIG. 2 except the key-touch regulator 75, description is focused on the key-touch regulator 75 without detailed description on the other components. The other components are labeled with the references designating corresponding components of the grand piano shown in FIG. 2.

Figure 11:
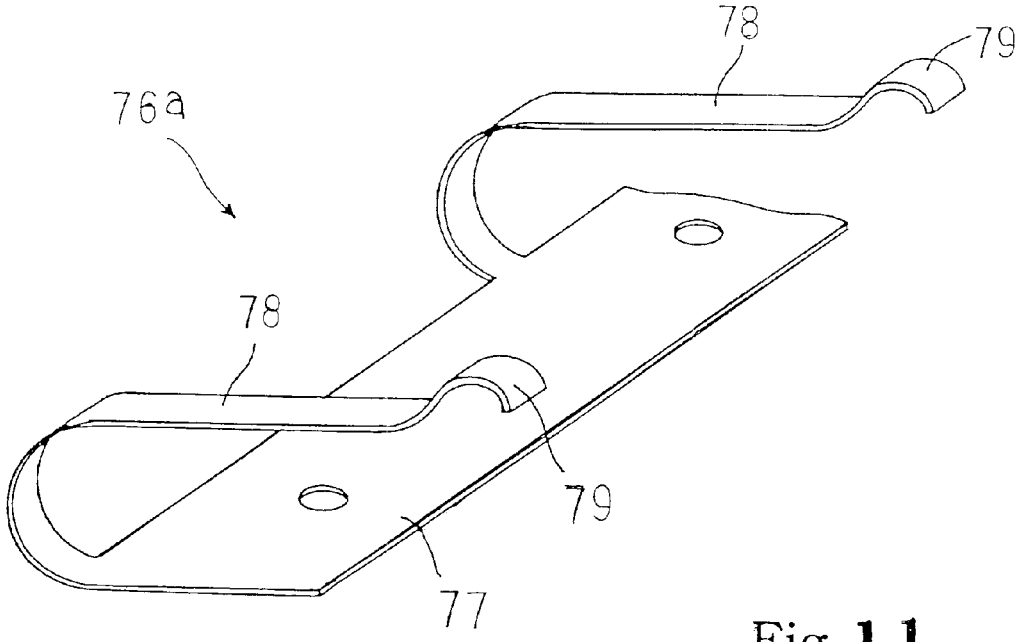
FIG. 11 is a perspective view showing the configuration of an array of leaf springs.

The plural sheets of felt or cloth 76*b* are adhered to the lower surfaces of the rear portions of the white/black keys 11A/11B. The key-touch regulator 75 includes an array of leaf springs 76*a* and plural sheets of felt or cloth 76*b*. As will be better seen in FIG. 11, the array of lead springs 76*a* has a boss portion 77 and leaf springs 78. Bolt-holes are formed in the boss portion 77 at intervals. The array of leaf springs 76*a* is placed on the key frame 22 such that the boss portion 77 laterally extends under the rear portions of the white/black keys 11A/11B, and the boss portion 77 is secured to the key frame 22 by means of bolts 80 (see FIG. 10). The leaf springs 78 are raised from the rear edge of the boss portion 77 at intervals, and are bent toward the front edge. The leading end portions of the leaf springs 78 are rounded, and the rounded portions 79 are elastically held in contact with the plural sheets of felt or cloth adhered to the lower surfaces of the white/black keys 11A/11B, respectively.

The array of leaf springs 76*a* is prepared as follows. First, a comb-like plate is punched out from a metal plate such as a steel plate or a brass plate. The teeth are upwardly bent, and are further bent at the intermediate portions thereof. The leading ends of the teeth are rounded so as to obtain the array of leaf springs 76*a*.

The leaf springs 78 upwardly urge the rear portions of the associated white/black keys 11A/11B, respectively, and exert the counter moments to the associated white/black keys 11A/11B. The counter moments cancel parts of the moments due to the total self-weight. Thus, the key-touch regulator 75 gives appropriate key-touch to pianists.

The key-touch regulator 75 achieves all the advantages of the key-touch regulator 17. The structure of the key-touch regulator 75 is simpler than those of the key-touch regulators 17/60. The simple structure results in reduction in production cost.

Fourth Embodiment

Figure 12:
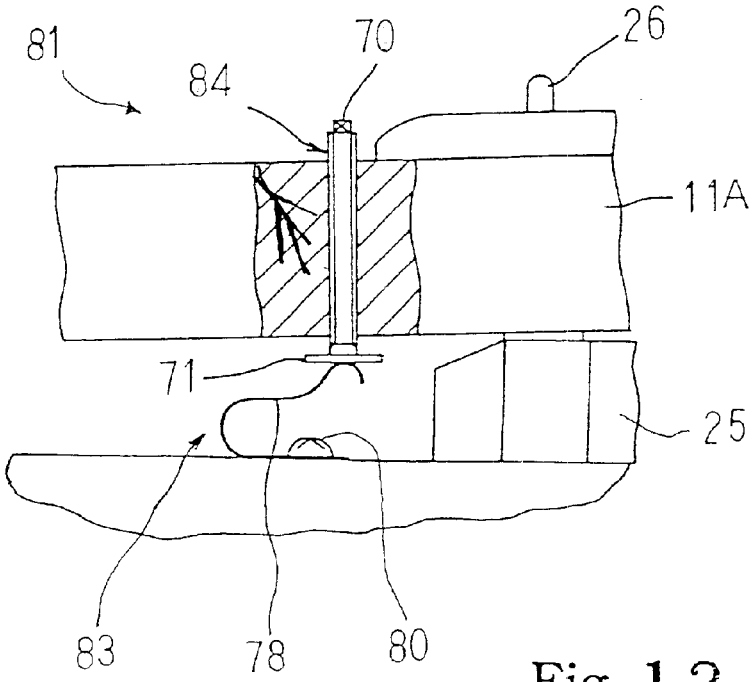
FIG. 12 is a partially cut-away side view showing the structure of yet another key-touch regulator according to the present invention.

FIG. 12 shows yet another key-touch regulator 81 embodying the present invention. The key-touch regulator 81 is the combination of an array of leaf springs 82 and an adjuster 83. The array of leaf springs 82 and the adjuster 83 are similar to the array of leaf springs 76*a* and the adjuster 64 except that the disc is integral with the adjusting screw. For this reason, the component parts are labeled with references designating corresponding component parts used in FIGS. 9 to 11 without detailed description. When the manufacturer or user wants to change the key-touch, he or she turns the adjusting screw 70 with a suitable tool so as to accumulate the elastic strain energy into or release it from the leaf springs 78. The elastic force and, accordingly, the counter moment are varied depending upon the elastic strain energy accumulated in the leaf springs 78. Thus, the manufacturer and/or user easily changes the key-touch by using the adjuster 81. Thus, the key-touch regulator 81 achieves the advantages of the second and third embodiment as well as those of the first embodiment.

As will be appreciated from the foregoing description, the keyboard musical instrument is equipped with the key-touch regulator between the keys and the stationary board. The key-touch generator exerts the elastic force on the keys so as to generate the counter moment against the moment initially exerted on the keys. Thus, the key-touch generator cancels part of the moment so that the user feels the key-touch appropriate.

The key-touch generator directly exerts the elastic force on the keys. This feature is desirable, because the key-touch regulator keeps the elastic force constant regardless of the tuning work on the capstan screws.

Moreover, the elastic member, i.e., the coil spring has a wide working range. This feature is further desirable, because the key-touch regulator according to the present invention works over the full stroke of the keys.

Although particular embodiments of the present invention have been shown and described, it will be apparent to those skilled in the art that various changes and modifications may be made without departing from the spirit and scope of the present invention.

The receiver 55 may be split into plural parts which are assigned plural key groups corresponding to the registers. The compression coil spring 58 may be replaced with another kind of spring such as, for example, a torsion bar. The spring may have linear load-to-elongation characteristics.

The plungers 57*b*/66 may be deleted from the pushers 56/62. In this instance, the compression coil springs 58/67 are directly connected to the receiver 55/63 or the key frame 22.

The array of leaf springs may be split into plural sections which are assigned to the key groups corresponding to the registers. Otherwise, individual leaf springs may be secured to the key frame.

The key-touch regulators 17/60/75/81 may be provided over the keyboard. In this instance, the key-touch regulator 17/60/75/81 is connected at one end thereof to the white/black key 11A/11B and at the other end thereof to a stationary board such as, for example, a pin block, regulating rail or whippen rail.

The adjusting screw does not set any limit on the adjuster. Another adjuster may be implemented by a lever for changing the length of the coil spring or the deformation of the leaf spring.

The key-touch regulator according to the present invention is useful to other kinds of keyboard musical instrument in so far as moment or force is initially exerted on the keys. Other kinds of keyboard musical instrument are, by way of example, an upright piano, a silent piano, an automatic player piano, an electric piano and a keyboard for practical use. The white/black keys incorporated in the upright piano have lead weights embedded in the rear portions thereof. For this reason, the key-touch regulator 17/64/75/81 are inserted between the key bed and the front portions of the keyboard.

The silent piano is a combination of an acoustic piano, i.e., a grand piano or upright piano and an electronic tone generating system, and a pianist can play a piece of music in acoustic tones or electronic tones. In order to permit the pianist to play a piece of music in the electronic tones, the silent piano is equipped with a hammer stopper and an electronic sound generating system. The hammer stopper is provided in association with the hammers, and is changed between a free position and a blocking position. While the hammer stopper is maintained at the free position, the hammers strike the associated sets of strings without any interruption by the hammer stopper. When the hammer stopper is changed to the blocking position, the hammer stopper enters into the trajectories of the hammers, and the hammers rebound on the hammer stopper before striking the strings. The electronic sound generating system produces electronic sounds instead of the piano tones so that user can practice the fingering without disturbance to the neighborhood.

The automatic player piano is a combination of an acoustic piano and an automatic playing system. The acoustic piano is either grand or upright. The automatic playing system includes solenoid-operated key actuators installed under the keyboard and a controller. When a set of music data codes is supplied to the controller, the controller analyzes the set of music data codes, and selects the keys to be moved from the keyboard and times at which the keys start the motion. When the time comes, the controller supplies a driving signal to the solenoid-operated key actuator under the key to be moved. The solenoid-operated key actuator moves the key at the give time, and the key actuates the action unit so as to give rise to free rotation of the hammer toward the string.

The keyboard for practical use is a modification of the acoustic piano. The hammer assemblies and strings are replaced with beaters and an impact absorber. While a trainee is fingering a piece of music on the keyboard, the depressed keys actuate the associated action units, which in turn give rise to free rotation of the hammers through the escape. The beaters rebound on the impact absorber, and the piano tones are not generated. An electronic tone generating system may be further incorporated in the keyboard for practical use. In this instance, sensors monitor the beaters, and periodically report the current positions of the beaters. The controller analyzes the series of positional data information so as to specify the depressed keys. The controller produces music data codes representative of the fingering on the keyboard, and supplies them to a tone generator. The tone generator produces an audio signal from the music data codes, and a sound system converts the audio signal to the electronic tones. Thus, the trainee checks the fingering for his training through the electronic tones.

The compression spring may be replaced with a tension spring. When the tension spring is incorporated in the key-touch regulator 17/64/75/81, the key-touch regulator is provided on the opposite side with respect to the balance rail.

What is claimed is:

1. A keyboard musical instrument comprising:

an array of keys selectively moved with respect to a stationary board by a human player;

a driven mechanism including plural units respectively linked with the keys of said array so as to be selectively actuated by the associated keys and exerting initial loads to said keys, respectively; and a touch-regulator having plural elastic force generating units provided between said keys and said stationary board and exerting elastic forces to said keys over the full strokes of said keys so as to cancel parts of said initial loads.

2. The keyboard musical instrument as set forth in claim 1, in which each of said elastic force generating units has a spring urging one of said keys in a direction opposite to the direction of the initial load.

3. The keyboard musical instrument as set forth in claim 2, in which said spring has non-linear force-and-deformation characteristics.

4. The keyboard musical instrument as set forth in claim 2, in which said each of said elastic force generating units further has a cylinder embedded in said one of said keys and a plunger movably housed in said cylinder, and said spring is inserted between an inner surface of said cylinder and said plunger.

5. The keyboard musical instrument as set forth in claim 4, in which said each of said elastic force generating units further has a cushion provided between a leading end of said plunger and said stationary board so as to eliminate noise from therebetween.

6. The keyboard musical instrument as set forth in claim 2, in which said spring is a coil spring.

7. The keyboard musical instrument as set forth in claim 2, in which said spring is a leaf spring connected at one end thereof to said stationary board and at the other end to said one of said keys.

8. The keyboard musical instrument as set forth in claim 7, in which said leaf spring is held in contact with a cushion adhered to said one of said keys.

9. The keyboard musical instrument as set forth in claim 1, in which said touch-regulator further includes elastic force adjusters associated with said plural elastic force generating units for independently changing said elastic forces.

10. The keyboard musical instrument as set forth in claim 1, in which each of said plural units of said driven mechanism includes a vibratory string, an action unit having a whippen rotatable around a stationary member and held in contact with one of said keys, a jack rotatably supported by said whippen and a regulating button supported by another stationary member and causing said jack to escape when said jack is brought into contact therewith and a hammer rotatably supported by yet another stationary member and driven for rotation by said jack at said escape for striking said vibratory string, and said keys are rotatably supported by yet another stationary member on said stationary board in such a manner as to be in contact with the whippens through capstan screws projecting from the rear portions thereof.

11. The keyboard musical instrument as set forth in claim 10, in which said plural elastic force generating units are provided between lower surfaces of the rear portions of said keys and said stationary board.

12. The keyboard musical instrument as set forth in claim 11, in which each of said elastic force generating units has a spring urging one of said keys upwardly.

13. The keyboard musical instrument as set forth in claim 12, in which said spring has non-linear force-and-deformation characteristics.

14. The keyboard musical instrument as set forth in claim 12, in which said each of said elastic force generating units further has a cylinder embedded in said one of said keys and a plunger movably housed in said cylinder, and said spring is inserted between an inner surface of said cylinder and said plunger.

15. The keyboard musical instrument as set forth in claim 14, in which said each of said elastic force generating units further has a cushion provided between a leading end of said plunger and a receiver fixed to an upper surface of said stationary board so as to eliminate noise from therebetween.

16. The keyboard musical instrument as set forth in claim 12, in which said spring is a coil spring.

17. The keyboard musical instrument as set forth in claim 12, in which said spring is a leaf spring connected at one end thereof to said stationary board and at the other end to the lower surface of said one of said keys.

18. The keyboard musical instrument as set forth in claim 17, in which said leaf spring is held in contact with a cushion fixed to the lower surface of said one of said keys.

19. The keyboard musical instrument as set forth in claim 11, in which said touch-regulator further includes elastic force adjusters associated with said plural elastic force generating units for independently changing said elastic forces.

20. The keyboard musical instrument as set forth in claim 19, in which said elastic force adjusters have respective adjusting screws engaged with threaded holes respectively formed in said keys.

* * * * *